US006997147B2

(12) United States Patent
Panciroli

(10) Patent No.: US 6,997,147 B2
(45) Date of Patent: Feb. 14, 2006

(54) ELECTROHYDRAULIC UNIT FOR ACTUATING THE VALVES OF AN ENDOTHERMIC ENGINE

(75) Inventor: Marco Panciroli, Ravenna (IT)

(73) Assignee: Magneti Marelli Powertrain S.p.A., (IT)

( * ) Notice: Subject to any disclaimer, the term of this patent is extended or adjusted under 35 U.S.C. 154(b) by 0 days.

(21) Appl. No.: 10/873,727

(22) Filed: Jun. 22, 2004

(65) Prior Publication Data

US 2005/0022758 A1 Feb. 3, 2005

(30) Foreign Application Priority Data

Jun. 23, 2003 (IT) ..... BO2003A0389

(51) Int. Cl.
*F01L 9/02* (2006.01)

(52) U.S. Cl. ..... 123/90.12; 123/90.11; 123/90.13

(58) Field of Classification Search ..... 123/90.11, 123/90.12, 90.13, 90.15
See application file for complete search history.

(56) References Cited

U.S. PATENT DOCUMENTS 4,009,695 A * 3/1977 Ule ..... 123/90.13
6,158,715 A * 12/2000 Kirschbaum ..... 251/129.06
6,412,457 B1 * 7/2002 Vorih et al. ..... 123/90.12
2002/0185091 A1 12/2002 Israel et al. ..... 123/90.12
2004/0035388 A1 2/2004 Diehl et al. ..... 123/322

FOREIGN PATENT DOCUMENTS

| | | |
|---|---|---|
| DE | 3911495 C1 | 8/1990 |
| DE | 19749302 A1 | 5/1999 |
| EP | 0915235 A | 5/1999 |
| JP | 60-169615 | 3/1985 |
| WO | WO98/30787 | 7/1998 |
| WO | WO03008770 A1 | 1/2003 |

OTHER PUBLICATIONS

European Search Report for EP 04 10 2849 (Sep. 21, 2004).

* cited by examiner

*Primary Examiner*—Thomas Denion
*Assistant Examiner*—Ching Chang
(74) *Attorney, Agent, or Firm*—Howrey LLP

(57) ABSTRACT

An electrohydraulic unit for actuating the valves of an endothermic engine is provided with a hydraulic actuator for lifting a respective valve by means of a pressurized liquid and a spring antagonistic to the hydraulic actuator in order to close the valve and to discharge the liquid from the hydraulic actuator in the final closure phase of the valve through a discharge branch provided with a calibrated orifice to slow down the expulsion of the liquid and maintain a substantially constant closing velocity of the valve during discharge of the liquid from the hydraulic actuator.

9 Claims, 4 Drawing Sheets

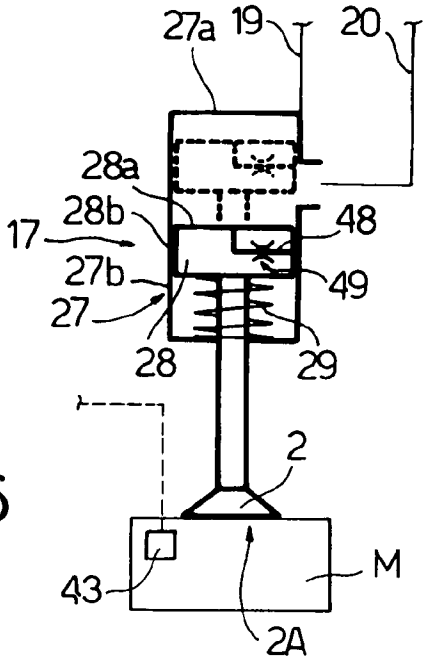
Fig.6
Fig.3
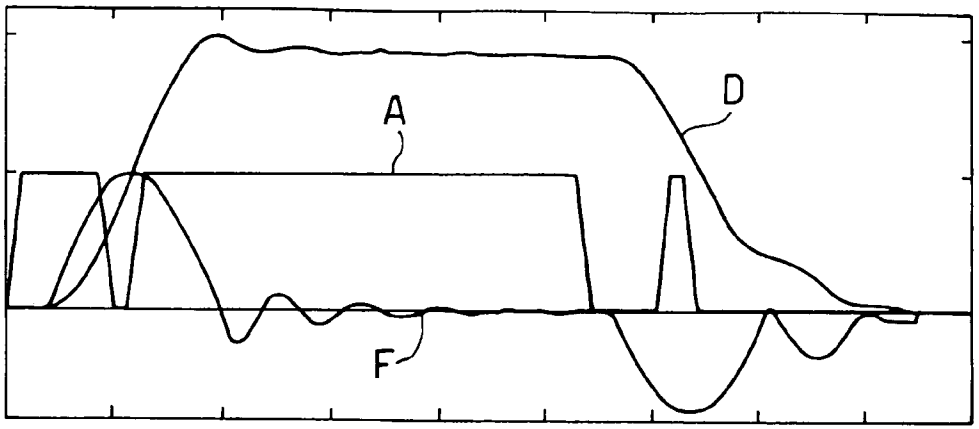
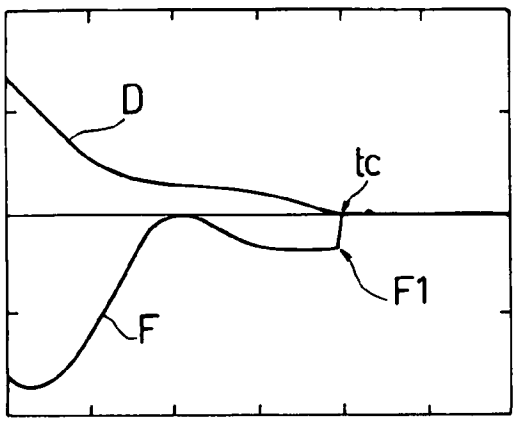
Fig.4

ELECTROHYDRAULIC UNIT FOR ACTUATING THE VALVES OF AN ENDOTHERMIC ENGINE

CROSS REFERENCE TO RELATED APPLICATIONS

The present application claims priority to Italian Patent Application Serial No. BO2003A 000389 filed Jun. 23, 2003.

FIELD OF THE INVENTION

The present invention relates to an electrohydraulic unit for actuating the valves of an endothermic engine.

DESCRIPTION OF RELATED ART

In general, the valves of an endothermic engine are moved mechanically by means of a camshaft. Alongside this well-established technology used in the automotive sector, alternative systems are currently in the experimental phase. In particular, the applicant is investigating an electrohydraulic unit for actuating the valves of an endothermic engine of the type described in patent application EP-1,233,152 in the name of the present applicant. The above-mentioned electrohydraulic unit is controlled by an electronic unit and makes it possible to vary very precisely the opening and closing times of each valve as a function of the angular velocity of the crankshaft and other operating parameters of the engine, substantially increasing the efficiency of the engine.

The electrohydraulic unit currently under investigation provides, for each of the engine's intake or exhaust valves, an electrohydraulic actuating device which comprises a linear hydraulic actuator capable of displacing the valve axially from the closed position to the maximally open position, overcoming the action of a resilient element capable of holding the valve in the closed position, and a hydraulic distributor capable of regulating the flow of pressurized oil away from and towards the hydraulic actuator in such a manner as to control the displacement of the valve between the closed position and the maximally open position.

In order to meet requirements for pressurized oil, the electrohydraulic unit under investigation is provided with a hydraulic circuit that comprises an oil-holding tank, within which the oil to be delivered to the actuators is stored, and a pumping unit capable of delivering the pressurized oil to the various distributors by taking it directly from the holding tank. The electrohydraulic unit described in patent application EP 1,233,152 comprises a slide valve distributor, which is capable of assuming a first operating position in which it places the hydraulic actuator in direct communication with a pressurized liquid discharge orifice, a second operating position in which it isolates the linear hydraulic actuator so as to prevent the oil from flowing away from and towards said actuator and a third operating position in which it places the linear hydraulic actuator in direct communication with an inlet orifice for the pressurized liquid.

The unit described has the considerable merit of having a particularly simple structure that ensures high levels of reliability over time, allowing its use in automotive applications.

However, the investigations currently under way have revealed some disadvantages arising from the elevated impact velocity of the valve during the closing phase.

SUMMARY OF THE INVENTION

The aim of the present invention is to produce an electrohydraulic unit for actuating the valves of an endothermic engine which is capable of achieving an approach of the valve during the closing phase with a relatively low and constant impact velocity.

According to the present invention an electrohydraulic unit is produced for actuating the valves of an endothermic engine, the electro hydraulic unit comprising a hydraulic actuator to open a respective valve by means of a pressurized liquid and a spring antagonistic to the hydraulic actuator in order to close the valve and to discharge the liquid from the hydraulic actuator in the final closure phase of the valve; the unit being characterized in that it comprises a calibrated orifice through which to pass said liquid in order to slow down the expulsion of the liquid and to maintain a substantially constant closing velocity of the valve during discharge of the liquid from the hydraulic actuator.

Thanks to the above-described unit, it is possible simply and economically to maintain the closing velocity of the valve at constant, relatively low values. A constant velocity is important because, as a result of wear to components of the unit, manufacturing tolerances and differential thermal expansion, it is not possible exactly to define the valve closure time over the lifetime of the engine. By maintaining a constant, relatively low velocity for a final portion of valve closure, it is certain that the impact will take place at a relatively low velocity under different wear conditions of the engine itself.

DESCRIPTION OF THE FIGURES

The present invention will now be described with reference to the attached drawings, which illustrate some non-limiting embodiments of the invention, in which:

FIG. 3 is a diagram relating to a sequence of positions and of velocities assumed by the valve;

FIG. 4 is a magnified portion of the diagram of FIG. 3;

FIG. 6 is a schematic diagram of a variant of the electrohydraulic unit of FIG. 1.

DETAILED DESCRIPTION OF THE INVENTION

Figure 1:
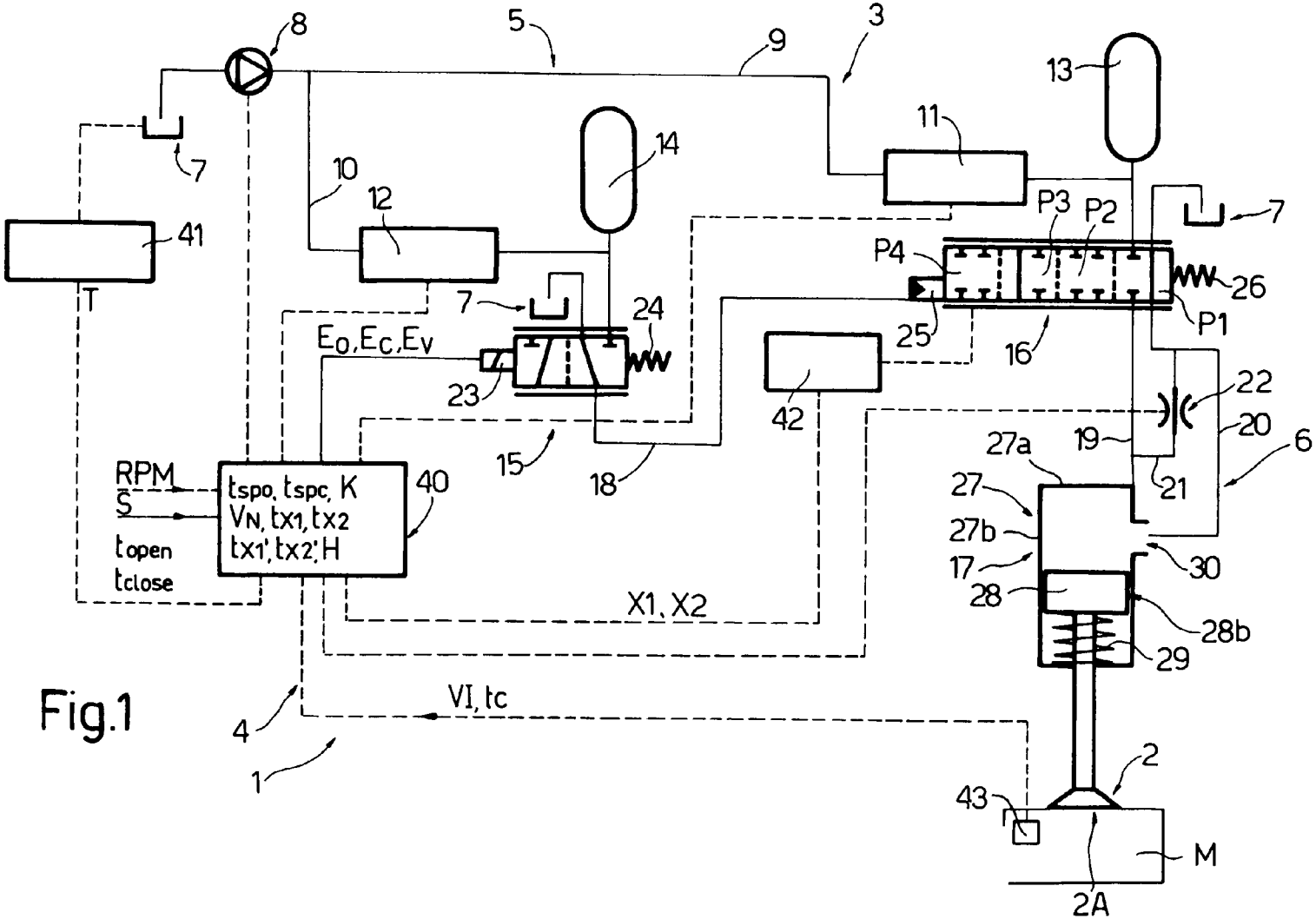
FIG. 1 is a schematic view of the electrohydraulic unit for actuating the valves of an endothermic engine.

With reference to FIG. 1, 1 denotes the overall electrohydraulic unit for actuating the valves 2 of an endothermic engine M. FIG. 1 shows just one valve 2 coupled with a respective seat 2A, although the electrohydraulic unit 1 is capable of controlling all the intake and exhaust valves of the engine M. In the present description, "opening of the valve 2" is taken to mean the phase of changing from the closed position of the valve 2 to the maximally open position; "closure of the valve 2" is taken mean the phase of changing between the maximally open position of the valve 2 and the closed position; and "holding" is taken to mean the phase during which the valve 2 remains in the maximally open position. Consequently, in relation to the valve 2, the terms open, close and hold have an analogous meaning.

The unit 1 comprises a hydraulic circuit 3 and a control device 4. In turn, the hydraulic circuit 3 comprises a circuit 5, common to all the valves 2, and a plurality of actuating devices 6, each of which is associated with a respective valve 2. For the sake of simplicity, FIG. 1 shows just one device 6 associated with the respective valve 2.

The circuit 5 comprises an oil holding tank 7, a pumping unit 8 and two branches 9 and 10, which are supplied with pressurized liquid and along which are successively arranged respective pressure regulators 11 and 12 and respective pressure accumulators 13 and 14. The two branches 9 and 10 of the circuit 5, downstream from the respective accumulators 13 and 14, are connected to the actuating devices 6, each of which comprises a control selector 15, a slide valve distributor 16 and a hydraulic actuator 17 rigidly coupled to the valve 2. The selector 15 is connected to the branch 10, to the tank 7 and to a branch 18 that connects the selector 15 to the distributor 16 in order to control the distributor 16 itself.

The distributor 16 is connected to the branch 9, to the tank 7, to a delivery branch 19 to the actuator 17 and a return branch 20 from the actuator 17. The branch 19 and the branch 20 are connected by a discharge branch 21, along which an orifice 22 is provided. The discharge branch 21 and orifice 22 have the function of slowing down the valve 2 in the closing phase and maintaining a constant velocity for closing the valve 2. In particular, slowing down of the valve 2 takes effect during the final part of the closing stroke of the valve 2, as will be described below in greater detail in the present description.

The selector 15 is a three-way valve controlled by an electromagnet 23 and by a spring 24 and is capable of assuming two positions: when the electromagnet 23 is not excited, the spring 24 holds the selector in the first position, in which the branch 10 is closed, while the branch 18 is connected to the tank 7 (FIG. 1); when excited, the electromagnet 23 overcomes the force of the spring 24 and places the selector 15 in the second position, in which the branch 10 is connected to the branch 18.

The distributor 16 is a four-way valve controlled by a piston 25 and by a spring 26 and is capable of assuming substantially four operating positions shown as P1, P2, P3 and P4 in FIG. 1. While the selector 16 has four operating positions P1, P2, P3 and P4, it actually has only two stable positions, namely the end positions respectively indicated as P1 and P4 in FIG. 1. The operating positions P2 and P3 are transitional positions between the opposing operating positions P1 and P4. In the operating position P1, the branch 20 is connected to the tank 7, while the branch 9 and the branch 19 are disconnected; in the operating position P2, all the connections are broken; in the operating position P3, the branch 9 is connected to the branch 19, while the return branch 20 is shut off: for this reason, the operating position P3 is defined as the actuating position; the operating position P4 again exhibits the same features as the operating position P2.

The linear hydraulic actuator 17 comprises a cylinder 27, a piston 28 connected to the valve 2 and a spring 29 capable of holding the valve 2 in the closed position. The cylinder 27 has a head 21*a* and a jacket 27*b*, along which a side discharge opening 30 is provided. The piston 28 comprises a crown 28*a* and a side face 28*b*, which, in specific positions of the piston 28, closes the opening 30.

Figure 5:
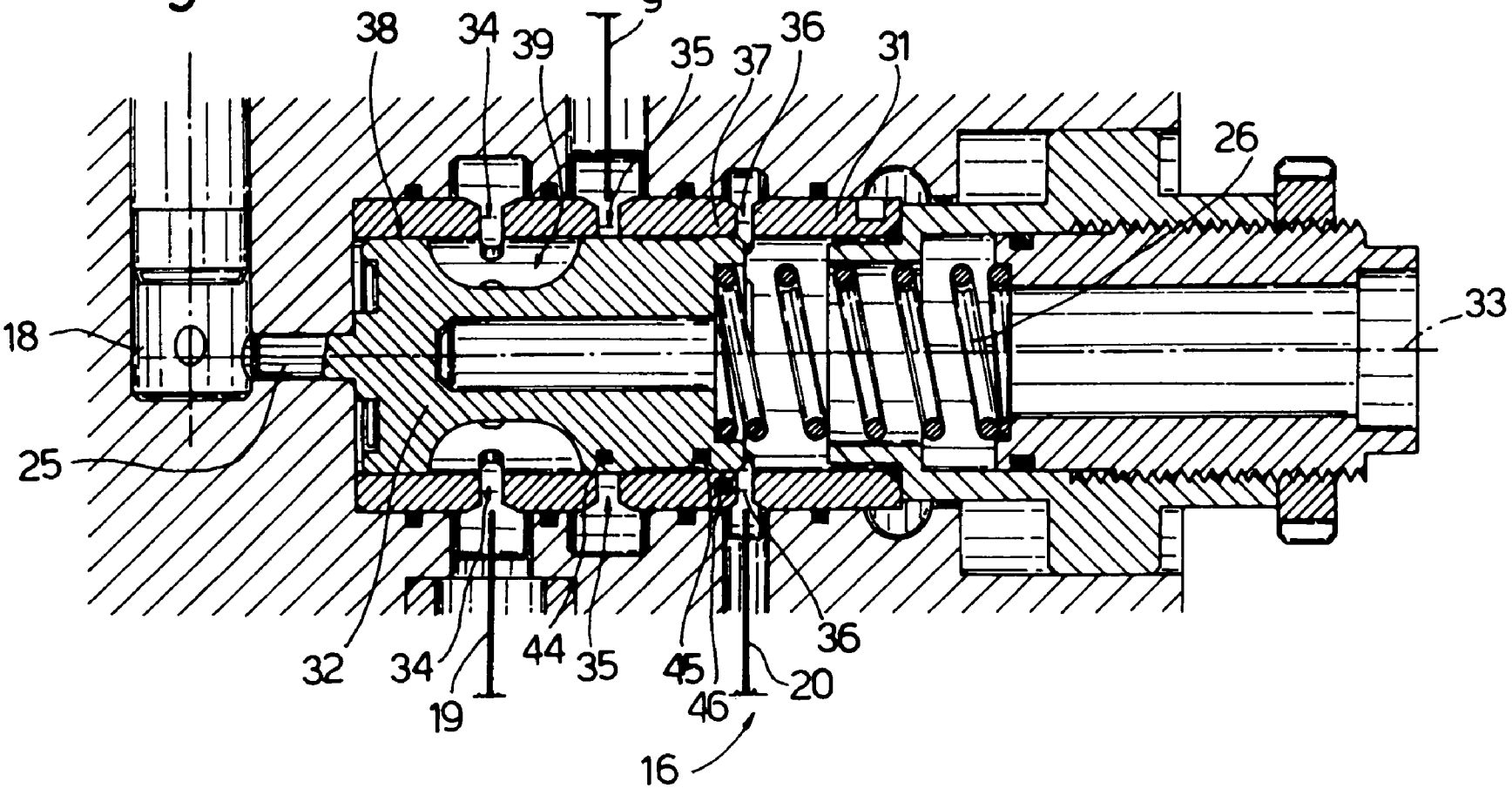
FIG. 5 is a sectional view of a component of the unit of FIG. 1.

In order to understand the functioning of the unit 1 better, it is necessary to describe the distributor 16 from the structural standpoint and with reference to FIG. 5, in which some components of the unit 1 are illustrated from the structural standpoint and bear the same reference numeral as in FIG. 1. The distributor 16 comprises a sleeve 31 and a slide valve 32 that slides inside the sleeve 31 along an axis 33. The branch 19, the branch 9 and the branch 20 communicate with respective series of radial holes 34, 35 and 36 provided in the sleeve 31. The radial holes 34, 35 and 36 of each series are distributed around the axis 33, while the series of radial holes 34, 35 and 36 are distributed along the axis 33 with a spacing determined as a function of the geometric characteristics of the slide valve 32, which comprises two faces 37 and 38, which substantially slide against the sleeve 31 and are separated by a recess 39. Essentially, there is a geometric relationship between the axial extent of the faces 37 and 38 and of the recess 39 and the axial position of the series of axial holes 34, 35 and 36 such as to define all the operating positions P1, P2, P3 and P4 of the slide valve 32. In particular, the dimensions of the slide valve 32 and the sleeve 31 make it possible to align the recess 39 simultaneously with both series of holes 34 and 35 and to align the face 38 with the series of holes 36, so as to shut off the return branch 20 and to supply pressurized oil from the branch 9 to the branch 19. The position described corresponds to the operating position P3 of FIG. 1 and is not actually a stable position of the slide valve 32: the open cross-section or port available to the oil for passage from the branch 9 to the branch 19 can be varied as a function of the position of the slide valve 32.

The control device 4 comprises an electronic control unit 40, which, on the basis of data captured from the engine M, such as for example rotational speed (RPM) and other operating parameters, determines the opening time and closing time for each valve 2. The unit 40 thus controls the electromagnet 23 in order to actuate in cascade the selector 15 of the distributor 16 and the linear actuator 17. The control device 4 furthermore comprises a sensor 41 for the temperature T of the oil; a sensor 42 for the position of the distributor 16 and a sensor 43 for the impact velocity of the valve 2.

With reference to FIG. 5, the position sensor 42 comprises two permanent magnets 44 and 45, which are embedded in the sliding component 32 and are arranged at a distance from one another that is equal to the difference between the strokes of the slide valve 32 capable of defining respectively the connection between the branches 9 and 19 and the disconnection between the branches 9 and 19 during the displacement of the slide valve 32 in the same direction. The sensor 42 comprises a detector 46 arranged along the sleeve 31. The geometry of the distributor 16 ensures that the connection between the branch 9 and the branch 19 begins after the slide valve 32 has been displaced by a first amount and is brought to an end after the slide valve 32 has been displaced by a second amount. In this manner, the detector 46 detects the passage of the magnet 45 (first amount of displacement), which corresponds to opening of the open cross-section, and the passage of the magnet 44 which corresponds to the closure of the open cross-section during displacement from P1 to P4. The order of detection is reversed on a return displacement from P4 to P1. Essentially, with two thresholds 44 and 45 and a single detector 46, it is possible to identify the opening and closing positions of the open cross-section due to the displacement of the slide valve 32 in both directions.

The sensor 43 takes the form of an accelerometer which detects the impact that occurs when the valve 2 comes back into contact with the respective seat 2A. The sensor 43 can also be a detonation sensor, the signal from which, when detected and filtered, indicates the behavior of each valve 2. Thus, by means of a sensor 43 fitted on the engine M, it is possible to detect the impact velocity for each valve 2 of the engine M. Alternatively, there can also be more than one sensor 43.

The unit 40, besides controlling the electromagnet 23, also controls the pressure regulators 11 and 12 and the open cross-section of the variable cross-section orifice 22.

Figure 2:
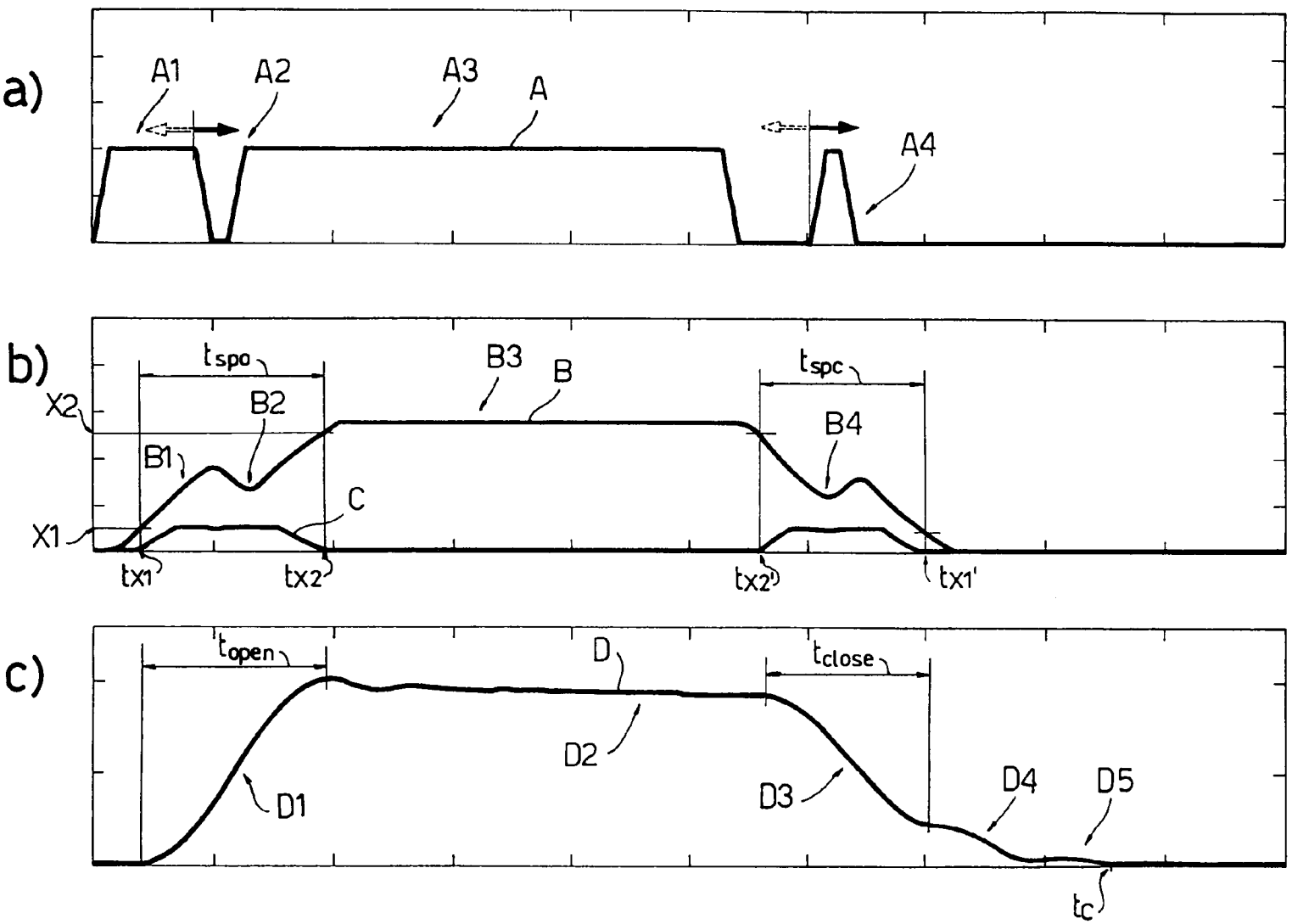
FIG. 2 is a diagram relating to a sequence of positions of various components of the electrohydraulic unit of FIG. 1.

In service, movement of the valve 2 proceeds in accordance with the diagram shown in FIG. 2, part a) of which shows the curve A which indicates the displacement (y-coordinates) of the selector 15 as a function of time (x-coordinates); part b) shows the curve B, which indicates the position (y-coordinates) of the distributor 16 and the curve C, which indicates the open cross-section or port (y-coordinates) connecting the branch 9 and the branch 19 as a function of time (x-coordinates); and part c) shows the curve D, which indicates the position (y-coordinates) of the valve 2 as a function of time (x-coordinates). Parts a), b) and c) are aligned in such a manner that their respective time scales are in phase throughout parts a), b) and c). In this manner, it is possible to compare the relationships between the positions of the selector 15, the distributor 16, the effect of the position of the distributor 16 on the open cross-section, and the position of the valve 2.

The principle of operation is based on the fact that the unit 40 excites the electromagnet 23 according to a cycle that is predetermined as a function of engine status: namely operating parameters such as torque, rotational speed or emissions. With reference to FIG. 2*c*), the valve 2 has a predetermined time $t_{open}$ that is necessary to open the valve 2 and a predetermined time $t_{close}$ that is necessary to close the valve 2, at least in part, which times are substantially constant and are determined by the equivalent mass and rigidity of the system, the system being taken to comprise the assembly formed by the piston 28, the valve 2, the spring 29 and the oil contained in the cylinder 27. The times $t_{open}$ and $t_{close}$ are captured experimentally and are correlated with the oscillation period of a system comprising the piston 28, the valve 2, the spring 29 and the oil. In order to obtain the required trajectory of the valve 2 while simultaneously minimizing energy losses, the opening time of the open cross-section must correspond to $t_{open}$ during the opening phase of the valve 2 and to the time $t_{close}$ during the closing phase of the valve 2.

However, as previously mentioned, the operating position P3 of the distributor 16 is not a stable position and, therefore, without detecting the position of the slide valve 32, it is not possible to detect the opening time of the open cross-section. In practice, as shown in FIG. 2*b*), the sensor 42 detects two points X1 and X2 of the curve B in order to determine the curve C of the open cross-section. In practice, the unit 40 detects the times $t_{X1}$ and $t_{X2}$ and calculates the time $t_{spo}$, which is equal to the difference between $t_{X2}$ and $t_{X1}$ and represents the time that elapses between the detection of the two points X1 and X2: the time $t_{spo}$ accordingly corresponds to the opening time of the open cross-section during the opening phase of the valve 2 and can be defined as the actuation time of the actuator 17 during the opening phase of the valve 2. Similarly, the unit 40 calculates the time $t_{spc}$ that elapses between the detection of the two points X2 and X1: the time $t_{spc}$ is equal to the difference between the times $t_{X1'}$ and $t_{X2'}$ and corresponds to the opening time of the open cross-section during the closing phase of the valve 2, which can be defined as the actuation time of the actuator 17 during the closing phase of the valve 2. The unit 40 subsequently calculates the respective differences between the values for $t_{spo}$ and $t_{spc}$ and the values for $t_{open}$ and $t_{close}$ and outputs respective error signals $E_o$ and $E_c$ when the calculated differences exceed respective threshold values H and K.

With reference to FIG. 1, in the absence of error signals $E_o$, $E_c$, the selector 15 operates according to a cycle in which change from the position shown in FIG. 1 to the position in which the branches 10 and 18 are connected defines the opening of the valve 2, holding of the connection between the branches 10 and 18 defines the valve 2 being held in the open position and breaking of the connection between the branches 10 and 18 defines the closure of the valve 2.

With reference to FIG. 2, the unit 40 displaces the selector 15 (portion A1 of the curve A) in order to open the valve (portion B1 of the curve B of the distributor 16 and portions D1 of the curve D of the valve 2). Subsequently, in the presence of an error. signal $E_o$, the unit 40 displaces the selector 15 (portion A2 of the curve A) in order to break the connection between the branches 10 and 18 temporarily during the lifting phase after the point X1 has been detected and before the point X2 has been detected in order to delay the closure of the open port and to synchronize the time $t_{spo}$ with the time $t_{open}$. The distributor 16 oscillates (portion B2 of the curve B) in the connection position between the branches 9 and 19.

While the valve 2 (portion D2 of the curve D, FIG. 2*c*)) is being held in the open position, the selector 15 remains in the connection position between the branches 10 and 18 (portion A3 of the curve A of the curve 2*a*)), such that the distributor 16 is arranged in the operating position P4 (portion B3 of the curve B, FIG. 2*b*)).

The breaking of the connection between the branches 10 and 18 defines the beginning of closure of the valve 2 (portion D3 of the curve D).

In the presence of error signal $E_c$, the unit 40 temporarily connects the branch 10 to the branch 18 (portion A4 of the curve A, FIG. 2*a*) during the closing phase of the valve 2 after the point X2 has been detected and before the point X1 has been detected in order to delay the closure of the connection between the branches 9 and 19. The distributor 16 oscillates during the closing phase in a position of connection between the branches 9 and 19.

In the example described above and shown diagrammatically in FIG. 2, the selector 15 is actuated after $t_{X1}$ has been detected in order to cut off the branches 10 and 18 temporarily and to vary the connection time $t_{spo}$ during the opening phase. However, such a temporary cut-off can be performed before the moment $t_{X1}$.

In each cycle, the unit 40 calculates the error signals $E_o$ and $E_c$ and optionally regulates the times $t_{spo}$ and $t_{spc}$ in the subsequent cycle, adjusting the displacement of the distributor 16 as a function of the times $t_{open}$ and $t_{close}$.

In order to understand the dynamic behavior of the unit 1, it is necessary to explain that during the opening of the valve 2, the assembly formed by the linear actuator 17, in the present case the piston 28 and the valve 2, performs, over the predetermined time $t_{open}$ a larger stroke than that necessary to define a balance between force of the spring 29 and the pressure of the circuit 3. This is attributable to the dynamic behavior of the assembly comprising piston 28, valve 2, spring 29 and oil. Since, during the opening phase of the valve 2, the connection between the branch 9 and the branch 19 is closed and the return branch 20 is shut off, the time required to establish a balance between the force of the spring 29 and the force of the pressure in the circuit 3 is not available. In fact, the spring 29, having been dynamically compressed more than it ought to have been, brings about a pressure in the closed cylinder 27 that is greater than the pressure of the liquid in the branch 9. This situation means that, during the closing phase of the valve 2, when the branches 9 and 19 are interconnected, some of the oil contained in the cylinder 27 flows back through the branch 19 to the branch 9. Essentially, the branch 19 performs not only the function of a delivery branch, but also that of a return branch. The phase of expelling the oil from the actuator 17 through the branch 9 is completed within the predetermined time $t_{close}$. This oil expulsion phase through the branch 9 corresponds to the initial closure phase of the valve 2. Obviously, friction means that recovery is incomplete and that the valve 2 is not completely closed at the end of this initial phase.

Subsequently, the distributor 16 reaches the operating position P1, in which the oil contained in the cylinder 27 is initially discharged through the opening 30 and the branch 20 (portion D4 of the curve D, FIG. 2*c*)). Displacement of the piston 28 during discharge of the oil to the tank 7 brings about progressive closure of the opening 30 and thus the residual oil contained in the cylinder 27 is discharged through the discharge branch 21 and the orifice 22 (portion D5 of the curve D, FIG. 2*b*)). The orifice 22 has the function of slowing down the descent of the valve 2 and maintaining a substantially constant closing velocity. The unit 40 is capable of varying the open cross-section of the orifice so as to regulate the closing velocity. Discharge of the oil first through the branch 20 and, subsequently, through the branches 20 and 21 corresponds to the final closure phase of the valve 2. Essentially, the closing phase of the valve 2 comprises a reflux phase of the oil through the branch 9 (portion D3 of the curve D in FIG. 2*c*), and a discharge phase of the oil towards the holding tank 7. This phase comprises two further phases: discharge through the opening 30 (in this phase discharge through the orifice 22 is negligible; portion D4 of the curve D in FIG. 2*c*)) and discharge through the orifice 22 (portion D5 of the curve D in FIG. 2*c*)).

With reference to FIG. 3, as well as the curve D relating to the displacement of the valve 2 and the curve A relating to the displacement of the selector 15, the curve F is shown relating to the velocity of the valve 2. With reference to FIG. 4, the final portion F1 of the curve F comprises a substantially horizontal portion indicating the constant closing velocity of the valve 2 at the moment $t_c$.

The orifice 22 can be regulated by the unit 40 in order to vary the open cross-section thereof. In practice, the sensor 43 detects a variable correlated with the impact velocity $V_1$ of the valve 2 on its respective seat 2A and compares the impact velocity $V_1$ with a reference velocity $V_N$. When the difference between the impact velocity $V_1$ and the reference velocity $V_N$ exceeds a threshold S, the unit 40 outputs an error signal $E_v$ and controls an actuator (not shown) in order to vary continuously the open cross-section of the orifice 22.

According to a variant that is not shown, the orifice has an open cross-section that can be varied in on/off manner between a value equal to zero and a maximum value. The unit 40 controls said open cross-section by means of a plurality of oscillation cycles between the zero value and the maximum value in order to define respective average values of the open cross-section. The average value of the open cross-section is a function of the frequency and amplitude of the oscillations in the cycle.

The methods hitherto described for regulating the cross-section make reference to closed loop operation, although open loop regulation is possible both using the on/off regulation method, which makes it possible to define an average cross-section, and using continuous regulation of the open cross-section.

With reference to the variant of FIG. 6, the branch 21 and orifice 22 have been omitted and are replaced by a branch 48 and by an orifice 49 of constant cross-section and arranged along the branch 48, which is arranged completely within the piston 28 and has an orifice arranged along the crown 28*a* and an orifice arranged along the face 28*b* of the piston 28. When, during the closing phase of the valve 2, the face 28*b* of the piston 28 closes the opening 30, the oil contained in the cylinder 27 is inevitably expelled through the branch 48 and the orifice 49, so slowing down the valve 2 in the approach phase of the valve 2.

The present description has made specific reference to oil as the liquid used in the hydraulic system, but it is understood that oil can be replaced with any other liquid without consequently extending beyond the scope of protection of the present invention.

What is claimed is:

1. An electrohydraulic unit for actuating the valves of an endothermic engine comprising a hydraulic actuator for lifting a respective valve by means of a pressurized liquid and a spring antagonistic to the hydraulic actuator in order to close the valve and to discharge the liquid from the hydraulic actuator in the final closure phase of the valve; the unit being characterized in that it comprises a calibrated orifice through which to pass said liquid in order to slow down the expulsion of the liquid and to maintain a substantially constant closing velocity of the valve during discharge of the liquid from the hydraulic actuator; characterized in that it comprises regulation means for varying the open cross-section of said calibrated orifice in such a manner as to regulate the closing velocity of the valve; said calibrated orifice having an open cross-section that can be varied between a minimum value and a maximum value; said regulation means being capable of varying said open cross-section by means of a plurality of oscillation cycles between said maximum value and said minimum value; each oscillation cycle having a corresponding average value of the open cross-section.

2. The unit of claim 1, in which the final closure phase of the valve comprises successively a first discharge phase and a second discharge phase; the unit being characterized in that it comprises a discharge branch along which is arranged said calibrated orifice, which is operational substantially in the second discharge phase.

3. The unit of claim 2, characterized in that it comprises a further discharge branch; said hydraulic actuator comprising a cylinder and a piston that slides in said cylinder; said further discharge branch being connected to said cylinder at a point such that, by means of the piston, it shuts off the direct supply from said cylinder to the further discharge branch in the second discharge phase.

4. The unit of claim 3, characterized in that said cylinder is provided with a side opening connected to said further discharge branch; said piston being capable of permitting direct communication between said cylinder and said further discharge branch for a first portion of the stroke of the piston through the opening and of cutting off said communication for a second portion of the stroke of the piston.

5. The unit of claim 3, characterized in that said cylinder comprises a head and a jacket; said discharge branch being connected in proximity to said head.

6. The unit of claim 3, characterized in that said discharge branch connects said cylinder to said further discharge branch.

7. The unit of claim 3, characterized in that said piston comprises a crown and a side face; said discharge branch being arranged within said piston and extending from said crown to said side face.

8. The unit of claim 1, characterized in that said minimum value of the open cross-section is equal to zero.

9. The unit of claim 1, characterized in that it comprises capture means for capturing the impact velocity; said regulation means operating as a function of said impact velocity.

* * * * *